United States Patent [19]

Benvenuti

[11] Patent Number: 4,608,953

[45] Date of Patent: Sep. 2, 1986

[54] SAFETY INTERLOCK FOR A MOTOR VEHICLE ENGINE STARTING CIRCUITRY

[75] Inventor: Livio Benvenuti, La Rotta, Italy

[73] Assignee: Piaggio & C. S.p.A., Genua, Italy

[21] Appl. No.: 672,385

[22] Filed: Nov. 16, 1984

[30] Foreign Application Priority Data

Nov. 25, 1983 [IT] Italy ..... 23895 A/83

[51] Int. Cl.[4] ..... F02D 11/10

[52] U.S. Cl. ..... 123/335; 123/198 DC

[58] Field of Search ..... 123/335, 198 DC

[56] References Cited

U.S. PATENT DOCUMENTS

| | | | |
|---|---|---|---|
| 3,601,103 | 8/1971 | Swiden | 123/335 |
| 4,074,665 | 2/1978 | Patis | 123/335 |
| 4,297,977 | 11/1981 | Boyama | 123/335 |

*Primary Examiner*—Ronald B. Cox

*Attorney, Agent, or Firm*—Hedman, Gibson, Costigan & Hoare

[57] ABSTRACT

A speed-limiting device of the electronic ignition type for the internal combustion engine of a motor vehicle is equipped with an AC generator driven to rotation by the engine, such a generator comprising a feeding coil for the electronic ignition circuitry and a pickup winding for controlling the sparking of the engine spark plugs is characterized in that the signal of said control of the sparking for the igniting spark is cut off by short-circuiting to ground the pickup winding via a diode which is governed by the voltage generated by said feeding coil of the ignition circuitry, a voltage which is appropriately processed by a specially provided electric circuitry so as to become proportional to the generator speed as the voltage in question overtakes a threshold magnitude as preset by a specially provided sensing member.

1 Claim, 1 Drawing Figure

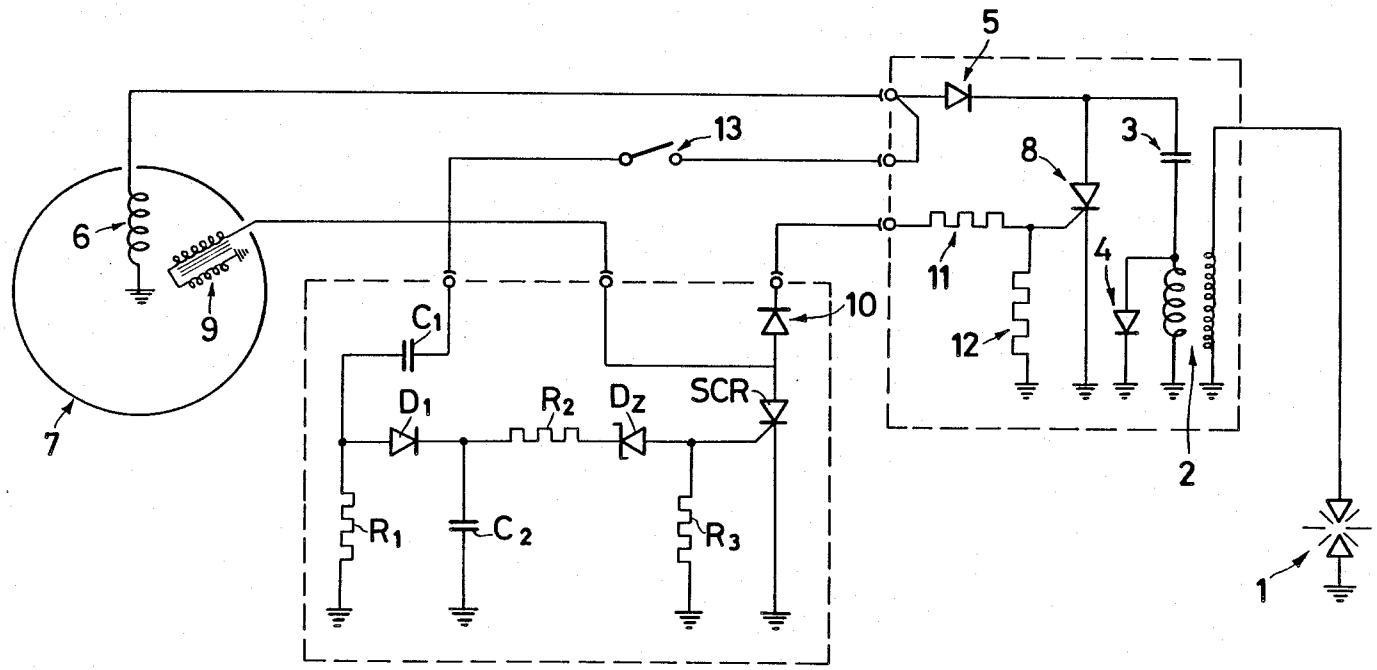
1
2
3
4
5
6
7
8
9
10
11
12
13
SCR
$R_3$
$D_Z$
$R_2$
$C_2$
$C_1$
$D_1$
$R_1$

SAFETY INTERLOCK FOR A MOTOR VEHICLE ENGINE STARTING CIRCUITRY

In a two-wheeled vehicle driven by an internal-combustion engine and equipped with an automatic clutching mechanism to transfer the drive to the vehicle wheels, whenever, with the vehicle in stationary condition, the ignition key is in the starting position, it may occur, as a result of a too wide throttling of fuel feed, or in order to preheat the engine more swiftly, or, also to clean the carburettor, or merely by absence of mind of the driver, that which causes a more or less abrupt increase of the engine speed, that the automatic clutch is brusky caused to enter action and that the vehicle may run out of the control of the driver before the driver is in readiness to start, the dangerous consequence of this fact being apparent.

To prevent such a drawback from occurring, the driver could brake the vehicle all the starting time throughout, but it is already customary, on the majority of the two-wheeled vehicles having an automatic transmission mechanism to employ electronic devices which prevent the engine from attaining the speed required for clutching by cutting off the ignition properly. More particularly, such electronic devices are governed by the voltage of the pickup winding, said winding being inserted in the electric generator which controls the instant of time of ignition: this voltage is proportional to the speed of the engine.

There are, however, vehicles which are equipped with an electric generator with such pickup winding constructed for quite special purposes, for example in the case of two-stroke engines, to prevent starting in the wrong sense, so as to deliver, on not, a voltage proportional to the speed, so that the conventional electronic devices cannot be used.

Consequently, an objective of the present invention is a quite special ignition circuitry which comprises particular electric and electronic component parts and which is susceptible of being applied, simply and cheaply, to generators of the kind in which the voltage of the ignition pickup winding is not proportional to the engine speed.

The characterizing feature of the invention stands in that there has been exploited, as the cutoff signal for the ignition circuit, the very voltage of the feeding coil of the generator, by inserting an integrating component part which is capable of modifying the trend of such a voltage in a manner proportional to the generator speed, and thus to the engine speed, and in that such voltage, so modified, has been exploited to short-circuit the pickup winding controlling the sparking of the ignition circuitry.

The invention is diagrammatically illustrated in the single accompanying drawing:

An ignition plug 1 can be fed, via a transformer coil 2, a capacitor 3, a dampening diode 4 and a rectifying diode 5, by the winding 6 of the AC generator 7 only whenever the controlled diode 8, shunted relatively to the coil 2 and the capacitor 3, allows the current to flow therethrough. The control for the diode 8 is effected by a specially provided pickup winding, which is the winding 9 of the generator 7, via the rectifying diode 10, the clipping resistor 11 and the biassing resistor 12.

The speed-limiting device for the engine and the generator is composed of the circuit which consists of the capacitor $C_1$, the rectifying diode $D_1$, the resistor $R_2$, the Zener diode $D_z$, the controlled diode SCR and the relative branches shunted to ground which comprise the resistor $R_1$, the capacitor $C_2$ and the resistor $R_3$. A switch 13 makes it possible to cut the limiting device in question off. The capacitor $C_1$ and the resistor $R_1$ are properly designed to convert the trend of the voltage of the charging winding 6 in a manner proportional to the speed. The Zener diode $D_z$ makes possible the flow of the current rectified by the diode $D_1$ and levelled by the capacitor $C_2$ and the dampening resistor $R_2$ to the grid of the SCR diode; the latter, as the voltage attains the preset magnitude, short-circuits the current of the pick-up winding to ground, thus cutting the ignition current off.

This invention can be applied to single- or plural-cylinder engines and is capable of being otherwise applied for purposes other than those disclosed hereinbefore.

I claim:

1. A device for limiting the speed of an internal combustion engine having an electronic ignition circuit, comprising:

an alternating current generator driven by the rotation of the engine, said generator having a winding coil for supplying a voltage to the electronic ignition circuit and a pickup winding for controlling the sparking of the electronic ignition circuit; and a speed-limiting circuit including a first capacitor, a first resistor, a first rectifying diode having an anode and a cathode, a lead connecting one terminal of said first capacitor to the anode of said first diode, a lead connecting the other terminal of said first capacitor to said winding coil, a lead connecting one side of said first resistor to the anode of said first diode, a lead connecting the other side of said first resistor to ground, a second capacitor, a lead connecting one side of said second capacitor to the cathode of said first diode, a lead connecting the other terminal of said second capacitor to ground, a second resistor, a lead connecting one side of said second resistor to the cathode of said first diode a Zener diode having an anode and a cathode, a lead connecting the cathode of said Zener diode to the other side of said second resistor, a third resistor, a lead connecting one side of said third resistor to the anode of said Zener diode, a lead connecting the other side of said third resistor to ground, an SCR having an anode and a cathode, a lead connecting the cathode of said SCR to the anode of said Zener diode, a lead connecting the cathode of said SCR to ground, a second rectifying diode, having an anode and a cathode, a lead connecting the anode of said second rectifying diode to the anode of said SCR, and a lead connecting the cathode of said second rectifying diode to said electronic ignition circuit, a lead connecting said pickup winding to the lead connecting said second rectifying diode to said SCR, whereby the voltage generated by the winding coil feeds said SCR after processing through said speed-limiting circuit so as to be proportional to said generator speed whereupon the signal from said pickup winding is fed through said second rectifying diode and into said electronic ignition circuit when the rotation of the engine is below a preset threshold magnitude and through said SCR to ground whenever said voltage generated by the winding coil exceeds the preset threshold magnitude.

* * * * *